United States Patent [19]

Marsh et al.

[11] 4,142,737

[45] Mar. 6, 1979

[54] SEAT BELT SECURING DEVICE

[75] Inventors: Gerald J. Marsh, Warren; Kenneth H. Reid, Mt. Clemens; William C. Jarski, Oxford, all of Mich.

[73] Assignee: General Motors Corporation, Detroit, Mich.

[21] Appl. No.: 822,663

[22] Filed: Aug. 8, 1977

Related U.S. Application Data

[63] Continuation-in-part of Ser. No. 727,290, Sep. 27, 1976, abandoned.

[51] Int. Cl.[2] ..... B60R 21/10

[52] U.S. Cl. ..... 280/747

[58] Field of Search ..... 280/744, 747; 24/241 P, 24/241 PP, 241 PS; 297/388, 389

[56] References Cited

U.S. PATENT DOCUMENTS

| | | | |
|---|---|---|---|
| 3,194,602 | 7/1965 | Gottwald | 24/241 P |
| 3,227,490 | 1/1966 | Svensson | 297/389 |
| 3,510,151 | 5/1970 | Weman | 280/747 |
| 3,698,048 | 10/1972 | Weman | 24/241 P |
| 3,754,775 | 8/1973 | Williams | 280/747 |
| 3,844,001 | 10/1974 | Holmberg | 297/389 |
| 3,877,116 | 4/1975 | Holmberg | 24/241 PP |
| 3,920,265 | 11/1975 | Nilsson | 280/747 |

*Primary Examiner*—Robert R. Song
*Attorney, Agent, or Firm*—Charles E. Leahy

[57] ABSTRACT

A seat belt securing device includes a C-shaped hook member having upper and lower legs spaced apart to define a belt receiving slot having a forwardly facing open end. The lower leg is pivotally mounted on a mounting bracket attached to the vehicle body by a resilient yieldable support for positioning the hook member adjacent the hip of the seated occupant. The upper leg has a lower face engaged by the belt upon entry of the belt into the slot and is arranged relative the pivot so that belt force applied against the hook member by a retractor associated with the belt and by restraint of the occupant maintain the hook member in a downwardly directed belt capturing position. An abutment lip extends downwardly from the upper leg adjacent the open end to partially close the open end of the slot to assist retention of the belt against inadvertent disengagement. A gate member is pivotally mounted on the mounting bracket and is spring biased against the lip to normally close the open end of the slot. The spring yields to permit movement of the gate member to a slot opening position when engaged by the belt during engagement of the belt over the upper leg and insertion into the slot. During restraint of the occupant the resilient support yields to permit bodily forward and pivoting of the hook member and mounting bracket to maintain capture of the belt without imposing a load on the gate member. The hook member is manually pivoted rearwardly to an upwardly directed position to move the upper leg away from the gate member and release the belt for windup by the retractor. The belt securing device may be used in a continuous loop three-point belt system or in a two-point lap or shouler belt having a loop sewn on the belt end.

7 Claims, 4 Drawing Figures

SEAT BELT SECURING DEVICE

This is a Continuation-in-Part of application Ser. No. 727,290, filed Sept. 27, 1976 now abandoned.

The invention relates generally to a seat belt system and more particularly to a securing device for releasably securing a belt in an occupant restraining position.

Occupant restraint systems for motor vehicles commonly employ a shoulder belt which extends over the shoulder and across the chest of the occupant as well as a lap belt which extends across the lap of the seated occupant. One type of well known seat belt system is a three-point belt system comprising a single length of belt having its lower end mounted to the vehicle floor outboard the occupant seating position and its upper end attached to the vehicle body by an inertia responsive seat belt retractor. A device for securing the belt in an occupant restraining position includes a latch plate assembly mounted on the belt intermediate the ends and engageable with a buckle mounted inboard of the occupant seating position. The latch plate assembly divides the belt into a shoulder belt portion and a lap belt portion and may be secured at a fixed position on the belt or in the alternative is slidably movable thereon. The seat belt retractor utilized in such a seat belt system commonly utilizes a relatively strong windup spring which rotates a reel to wind a substantial portion of the shoulder belt onto the reel and suspend the latch plate assembly and the lap belt portion in a generally vertical stored position adjacent the wall of the passenger compartment.

It is advantageous that the winding force of the retractor windup spring be held at a minimum so that the comfort of the occupant is not impaired by an excessive effort applied against the body. It is also advantageous that the securing device be engageable and disengageable in a one-handed operation. Furthermore, it is advantageous that the securing device be of such a design that it can be disengaged to permit occupant egress of the vehicle even though the vehicle may have come to rest in an upside down attitude.

According to the present invention, a seat belt securing device includes a C-shaped hook member having upper and lower legs spaced apart to define a belt receiving slot having a forwardly facing open end. The lower leg is pivotally mounted on a mounting bracket attached to the vehicle body by a resilient yieldable support for positioning the hook member adjacent the hip of the seated occupant. The upper leg has a lower face engaged by the belt upon entry of the belt into the slot and arranged relative the pivot so that belt force applied against the hook member by a retractor associated with the belt and by restraint of the occupant maintain the hook member in a downwardly directed belt capturing position. An abutment lip extends downwardly from the upper leg adjacent the open end to partially close the open end of the slot and thereby assist retention of the belt against inadvertent disengagement. A gate member is pivotally mounted on the mounting bracket and is spring biased against the abutment lip to normally close the open end of the slot. The spring yields to permit movement of the gate member to a slot opening position when engaged by the belt during engagement of the belt over the upper leg and insertion into the slot. During restraint of the occupant the resilient support yields to permit bodily forward and pivoting of the hook member and mounting bracket to maintain capture of the belt without imposing a load on the gate member. The hook member is manually pivoted rearwardly to an upwardly directed position to move the upper leg away from the gate member and release the belt for windup by the retractor. The belt securing device may be used in a continuous loop three-point belt system or in a two-point lap or shoulder belt having a loop sewn on the belt end.

One object of the invention is the provision of a seat belt securing device which engages a continuous loop of belt directly without the intermediary of a latch plate mounted on the belt.

A further object of the invention is the provision of a belt securing device which is easily engaged in a one-handed operation without requiring visual orientation of the belt securing elements.

A still further object of the invention is the provision of a seat belt securing device which may be readily disengaged when the vehicle comes to rest in an unconventional attitude.

A further object of the invention is the provision of a seat belt securing device which may be pivoted from a belt capturing position to a belt releasing position without the release of a latch.

These and other features, objects and advantages of the invention will become apparent upon consideration of the specification and the appended drawings in which.

Figure 1:
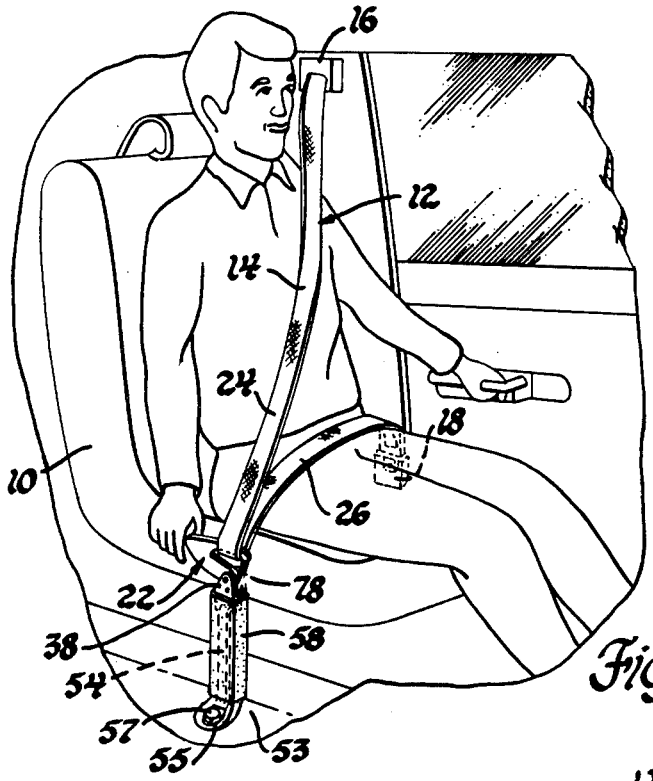
FIG. 1 shows the belt system in the occupant restraining position by engagement of the securing device.

Referring to FIG. 1, there is shown a motor vehicle occupant compartment wherein a vehicle seat 10 is conventionally arranged. A seat belt system, generally indicated at 12, is provided for restraining the occupant in the seated position.

The seat belt system 12 includes a single loop of seat belt 14 which has its upper end attached to the vehicle body by an inertia responsive retractor 16 and its lower end conventionally attached to the vehicle body floor pan or body sill by an anchor bracket 18. A securing device, generally indicated at 22, is attached to the vehicle body inboard the seat 10. The securing device 22 engages the belt 14 in occupant restraining position as seen in FIG. 1 wherein the belt is divided into a shoulder belt portion 24 diagonally positioned against the chest of the occupant and a lap belt portion 26 which crosses the lap of the occupant.

Figure 2:
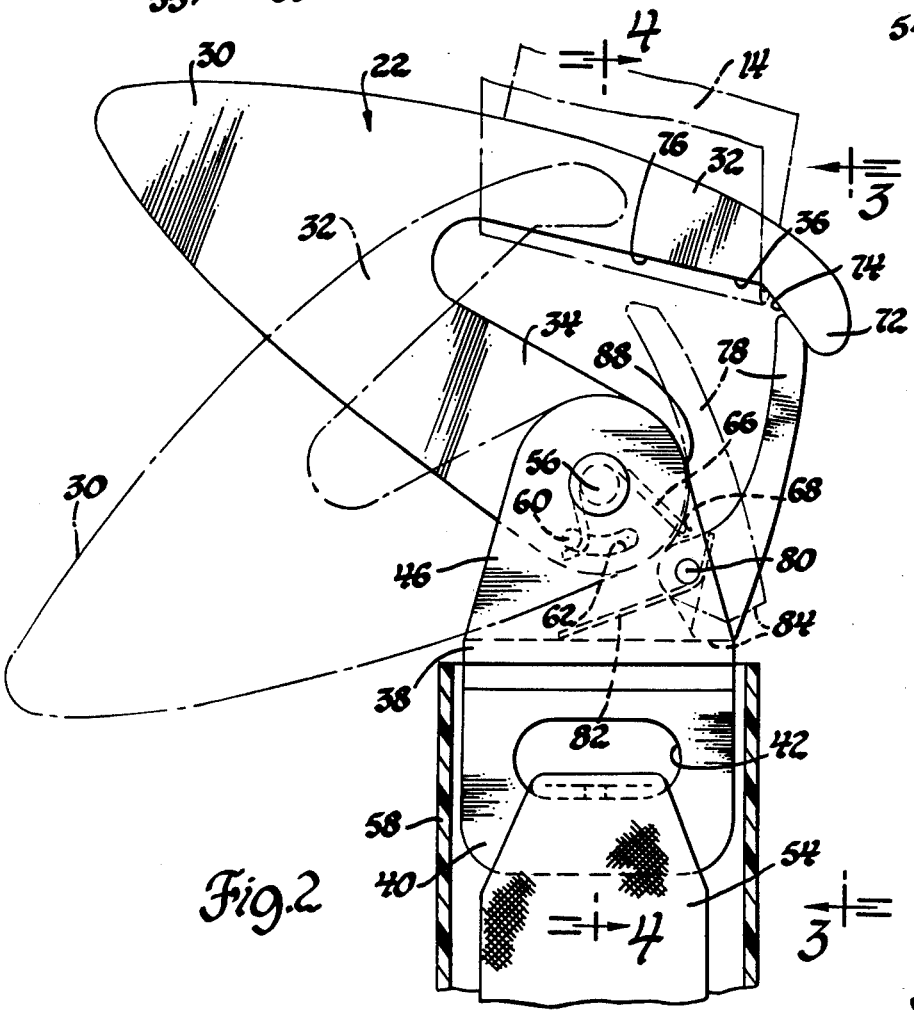
FIG. 2 is a side elevation view of the seat belt securing device wherein the belt securing position is shown in solid lines.
Figure 4:
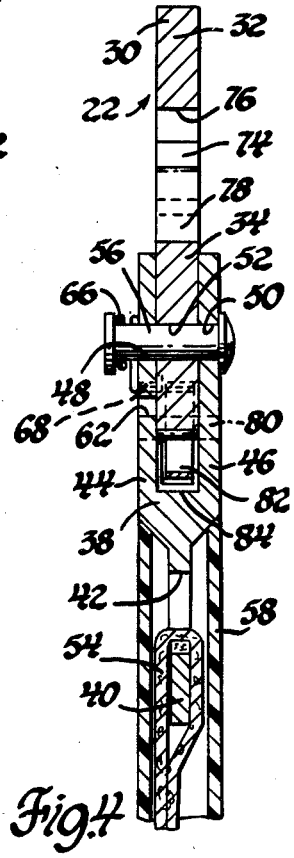
FIG. 4 is a sectional view taken in the direction of arrows 4—4 of FIG. 3.

Referring to FIG. 2, the securing device 22 includes a C-shaped hook member 30 having an upper leg 32 and a lower leg 34 which are spaced apart to define a belt receiving slot 36 which opens in the forward direction. The mounting bracket 38 has a lower end 40 having an aperture 42 and is mounted on the vehicle body as described hereinafter. Mounting bracket 38 has laterally spaced upwardly extending legs 44 and 46 which are juxtaposed with the lower leg 34 of hook member 30 and have respective apertures 48 and 50 aligned with a mating aperture 52 of the lower leg 34. A pivot shaft 56 extends through the apertures to pivotally mount the hook member 30 on the mounting bracket 38.

The mounting bracket 38 is mounted on the vehicle body floor pan 53 by a short length of strap 54 having its upper end extending through the aperture 42 of mounting bracket 38 and sewn to itself. The lower end of strap 54 is similarly sewn to an apertured anchor plate 55 which is connected to the vehicle floor pan 53 by a bolt 57. An injection molded plastic boot 58 surrounds the strap 54 and extends between engagement with the anchor plate 55 and the mounting bracket 38 to resiliently and yieldably position the securing device 22 adjacent the hip of the seated occupant.

Figure 3:
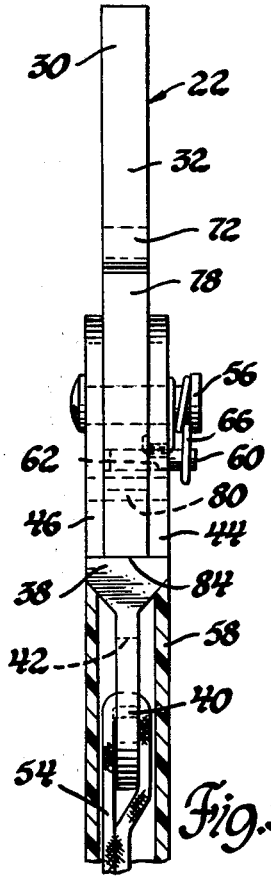
FIG. 3 is a view taken in the direction of arrows 3—3 of FIG. 2.

The pivot shaft 56 mounts the hook member 30 for pivotal movement between a belt capturing position shown in the solid lines of FIG. 2 and a belt releasing position shown in the phantom lines of FIG. 2. The limits of such rotation are defined by the interengagement between a laterally projecting pin 60 mounted on the lower leg 34 and a slot 62 provided in the leg 44 of mounting bracket 38. As best seen in FIGS. 2 and 3, a torsion spring 66 encircles the pivot shaft 56 and has one end engaged in an aperture 68 provided in the leg 44 and its other end seated against the laterally projecting pin 60. The torsion spring 66 normally urges the hook member 30 to its solid-line position of FIG. 2 wherein the pin 60 is engaged with the end of slot 62. The torsion spring 66 yields to permit rotation of the hook member 30 to the phantom line indicated position wherein the pin 60 is engaged with the other end of the slot 62.

As best seen in FIG. 2, the upper leg 32 has an abutment lip 72 which extends downwardly therefrom toward the lower leg 34 to partially close the open end of the slot 36. The abutment lip 72 defines an angled surface 74 which is contiguous a belt engaging lower face 76 of the upper leg 32.

A gate member 78 is pivotally mounted on the mounting bracket 38 adjacent the open end of the slot 36. The gate member extends between the legs 44 and 46 of mounting bracket 38 and is pivotally mounted thereon by a pivot pin 80 which extends between legs 44 and 46. A leaf spring 82 acts between the mounting bracket 38 and gate member 78 to urge the gate member 78 to a normal position indicated in solid lines of FIG. 2 wherein a lower abutment face 84 of the gate member 78 seats against the mounting bracket 38 to limit the pivotal movement of gate member 78 by the leaf spring 82. When the gate member 78 is in this spring biased position, its upper end is engaged with the angled surface 74 of the upper leg abutment lip 72 so that the gate member effectively closes the open end of the slot 36. The leaf spring 82 is yieldable to permit pivotal movement of the gate member 78 to the phantom-line indicated position of FIG. 2 wherein the gate member 78 is engaged against a rounded end surface 88 of the hook member 30. When the gate member 78 is moved to its phantom-line indicated position, the slot 36 is opened to permit entry of the belt 14 into the slot as will be discussed hereinafter.

Referring again to FIG. 1, it will be understood that prior to entry of the occupant into the vehicle, the retractor 16 will have wound the belt to a stored position wherein the belt 14 is disposed adjacent the wall of the passenger compartment. When the occupant enters the passenger compartment and assumes the seated position, the belt system 12 may be deployed to its restraining position of FIG. 1. The occupant moves the belt system to the restraining position by hooking his right thumb under the belt 14 and unwinding the belt 14 from the retractor 16. The belt 14 is thrust against the gate member 78 causing it to pivot to its phantom-line indicated position of FIG. 2 as permitted by the yielding of the leaf spring 82. Accordingly, the belt 14 may be inserted into the slot 36 and over the upper leg 32 of the hook member 30 as seen in FIG. 1. After the belt enters the slot 36, the leaf spring 82 returns the gate member 78 to its solid-line indicated position of FIG. 2 wherein the slot is closed. When the gate member engages the abutment lip 72, there is an audible click which assures the occupant that the belt 14 is secured. The belt 14 is held in engagement with the lower face 76 of upper leg 32 by the tension exerted on the belt by retractor 16. The belt 14 is retained against inadvertent disengagement from the leg 32 by the effect of its edge bearing against the angled surface 74 of abutment lip 72. Futhermore, the belt 14 may bear against the gate member 78 so that it will not become inadvertently disengaged, particularly in those instances where a tension reliever is associated with the retractor 16.

Referring to the solid-line indicated belt capturing position of FIG. 2, it is seen that the upper leg 32 and particularly the belt engaging lower face 76 thereof is somewhat downwardly directed and the pivot shaft 56 is located with respect to the lower face 76 of the upper leg 32 so that the force applied on the hook member 30 by the belt 14 will not by itself move the hook member 30 to its phantom-line indicated belt releasing position. In particular, the pivot pin 56 is located forwardly of a perpendicular bisector of the belt engaging lower face 76. If the belt engaging lower face 76 is arcuate or curvilinear, the pivot shaft 56 is located forwardly of a perpendicular bisector of the chord which subtends that portion of the arcuate lower face 76 engaged by the belt 14.

Referring to FIG. 1, it will be understood that the inertia responsive retractor 16 is locked against belt unwinding when the vehicle encounters a predetermined inertia stimulus such as rapid deceleration of the vehicle. Forward excursion of the lower torso is limited by engagement with the lap belt portion 26 while forward excursion of the upper torso is limited by engagement with the shoulder belt portion 24. It will be appreciated that this forward loading of the seat belt 14 tends to disengage the belt 14 from the forward facing open end of slot 36. However, the aforedescribed downward direction of the upper leg 32 and the relationship between the lower face 76 and pivot pin 56 cooperate to induce forward pivoting and bodily shifting movement of the hook member 30 and mounting bracket 38 as permitted by resilient yielding of the strap 54 and the plastic support boot 58. Accordingly, the hook member 30 follows the limited forward excursion of the occupant as slack is removed from belt 14 and the seat cushion is compressed, so that the belt is retained in engagement of the lower face 76 and does not become bunched up against the angled surface 74 and gate member 78 or impose any significant load thereon. Thus, it will be appreciated that the angled surface 74 and the gate member 78 are desirable to insure against inadvertent disengagement of the belt from the upper leg 32 but are not mandatory for effective restraint of the occupant during an emergency situation.

When the occupant desires to alight from the vehicle, the hook member 30 is manually gripped and pivoted rearwardly to the phantom-line position of FIG. 2 wherein the upper leg 32 assumes an upwardly directed attitude wherein the belt is released for retraction by the retractor 16. As the hook member 30 is pivoted rearwardly to its phantom-line indicated position, the leaf spring 82 maintains the gate member 78 in the solid-line indicated position so that the upper leg 32 moves away from the gate member 78 to open the end of the slot 36 and permit removal of the belt 14 therefrom by the windup effort of the retractor 16. The hook member 30 provides an integral lower arm extending rearwardly of the pivot shaft 56 by which a modest effort applied to the rearward end thereof by the occupant will pivot the hook member 30 to the phantom-line indicated upwardly directed belt releasing position even though the belt may be loaded by the weight of the occupant's body. This ability of the occupant to disengage the belt is important when the vehicle comes to rest in those unconventional attitudes wherein restraint of the occupant is important and yet must be terminated to enable the occupant to alight from the vehicle.

Referring again to FIG. 1, it will be understood that the securing device 22 of this invention may be used for securing a two-point lap or shoulder belt. In such an application, one end of the lap or shoulder belt would be anchored on the vehicle body by an anchor plate or a retractor. The other end of the seat belt would be reversely folded and sewn to itself to provide a loop capable of engagement over the upper leg 32 and insertion into the slot 36 of securing device 22. Furthermore, the securing device may be mounted on the occupant seat associated with the vehicle body instead of directly on the vehicle body.

Thus, the invention provides a new and improved device for securing a seat belt in an occupant restraining position independently of any securing element carried on the belt.

The embodiments of the invention in which an exclusive property or privilege is claimed are defined as follows:

1. In a vehicle body seat belt system having one end of the belt anchored at one side of the seated occupant, and a loop of belt adapted for securement at the other side of the seated occupant, and a securing device at the other side of the seated occupant for releasably capturing the belt in a restraining position about the occupant, said securing device comprising:

mounting means on the vehicle body at the other side of the seated occupant;

a hook member having a forward opening belt receiving slot defining a lower mounting leg and an upper leg having a belt engaging portion for engaging the belt upon entry of the belt into the slot;

a pivotal mount acting between the mounting means and the mounting leg of the hook member and being located relative the belt engaging portion of the upper leg so that force applied against the hook member by the belt during restraint of the occupant by the belt maintains the belt engaging portion and belt receiving slot in a downwardly directed belt capturing position;

said hook member being pivotally movable to an upwardly directed belt releasing position upon manual pivoting effort applied thereto by the seated occupant to release the belt for movement from the restraining position.

2. In a vehicle body seat belt system having one end of the belt anchored at one side of the seated occupant and a loop of belt adapted for securement at the other side of the seated occupant, a securing device at the other side of the seated occupant for releasably capturing the belt in a restraining position about the occupant, said securing device comprising:

a C-shaped hook member having upper and lower legs spaced apart to define a forward facing belt receiving slot having an open end;

pivot means acting between the vehicle body and the lower leg to mount the hook member adjacent the hip of the seated occupant for pivotal movement about an axis extending generally transversely of the vehicle body between a belt capturing position wherein the legs and the slot extend in a downwardly and forwardly direction and a belt releasing direction wherein the legs and the slot extend in an upwardly and forwardly direction;

an abutment lip extending downwardly from the upper leg toward the lower leg to partially close the open end of the slot and thereby retain the belt in the slot upon its insertion into the slot and over the upper leg to capture the belt in the restraining position;

and spring means normally urging the hook member to the downwardly extending belt capturing position and being yieldable to permit the occupant to pivot the hook member to the upwardly extending direction wherein the belt is released from the hook member for movement from the restraining position.

3. In a vehicle body seat belt system having one end of the belt anchored at one side of the vehicle seat and a loop of belt adapted for securement at the other side of the seated occupant, a securing device at the other side of the seat for releasably capturing the belt in restraining position about the occupant, said securing device comprising:

a C-shaped hook member having upper and lower legs spaced apart to define a belt receiving slot having a forwardly facing open end;

a mounting bracket mounted on the vehicle body;

pivot means acting between the mounting bracket and the lower leg to mount the hook member for pivotal movement about an axis extending generally transversely of the vehicle body;

first spring means acting between the mounting bracket and the hook member and urging the hook member to a normal position wherein the legs and the slot extend in a downwardly and forwardly direction;

a gate member pivotally mounted on the bracket adjacent the open end of the slot;

second spring means urging the gate member to a position closing the open end of the slot and yielding to permit movement of the gate member to a slot opening position when engaged by the belt during engagement of the belt loop over the upper leg and insertion of the belt into the belt receiving slot, said second spring means returning the gate member to the slot closing position after entry of the belt into the slot;

said first spring means yielding to permit rearward pivoting movement of the hook member to a position wherein the upper leg is moved away from the gate member and extends in an upwardly direction to release the belt and permit movement of the belt from the restraining position.

4. A seat belt system for restraining a seated occupant in a vehicle seat and comprising:

a restraint belt having upper and lower ends anchored at one side of the vehicle seat; a hook member having a forward facing open end slot for receiving the belt and a belt engaging portion engageable by the belt; pivot means mounting the hook member on the vehicle body adjacent the other side of the seat for pivotal movement of the belt engaging portion between a forwardly and downwardly directed position for capturing the belt in an occupant restraining position independently of any cooperating belt securing device carried by the belt and a forwardly and upwardly directed belt releasing position; belt retracting means at the anchorage of one of the belt ends for maintaining the belt in engagement with the belt engaging portion of the hook member and for moving the belt from the restraining position to a stored position upon pivoting of the hook member to the belt releasing position; said pivot means being arranged relative the belt engaging portion so that force applied against the hook member by the belt during restraint of the occupant maintains the belt engaging portion and belt receiving slot in a downwardly directed belt capturing position.

5. In a vehicle body seat belt system having a belt loop anchored at one side of the seated occupant and a securing device at the other side of the seated occupant for releasably capturing the belt loop in a restraining position about the seated occupant, said securing device comprising: a mounting bracket, a resilient support mounting the mounting bracket adjacent the hip of the seated occupant, a hook member having a forward facing open end belt receiving slot defining a lower mounting leg and an upper leg having a belt engaging portion for engaging the belt upon entry of the belt into the slot; pivot means acting between the mounting bracket and the mounting leg of the hook member to provide a transverse pivot axis and being arranged relative the belt engaging portion of the upper leg so that force applied against the hook member by the belt maintains the belt engaging portion and belt receiving slot in a downwardly directed forward facing belt capturing position; said resilient support permitting bodily forward and pivoting movement of the hook member and mounting bracket under force applied thereto by forward momentum of the restrained occupant whereby the hook member follows the limited forward and downward excursion of the occupant to maintain capture of the belt within the forward facing open end slot.

6. In a vehicle body, an occupant restraint belt system comprising: a belt having an end anchored on the vehicle body at one side of the vehicle seat and a loop of belt at the other side of the seat, a hook member having a forward facing open end belt receiving slot defining a lower mounting leg and an upper leg having a belt engaging portion for engaging the belt upon entry of the belt in the slot; resilient yieldable mounting means supporting the hook member adjacent the hip of the seated occupant and orienting the belt engaging portion of the upper leg in a downwardly directed belt capturing position; belt retracting means associated with the anchored end of the belt and maintaining the belt in engagement with the belt engaging portion of the hook member, said resilient yieldable mounting means permitting bodily forward and pivoting movement of the hook member under force applied thereto by forward momentum of the restrained occupant whereby the hook member follows the limited forward and downward excursion of the occupant to maintain capture of the belt within the forward facing open end slot.

7. In a vehicle body seat belt system having a belt loop anchored at one side of the seated occupant and a securing device at the other side of the seat for releasably capturing the belt in a restraining position about the seated occupant, said securing device comprising: a mounting bracket, a resilient support mounting the mounting bracket adjacent the hip of the seated occupant; a hook member having a forward facing open end belt receiving slot defining a lower mounting leg and an upper leg having a belt engaging portion for engaging the belt upon entry of the belt into the slot; pivot means acting between the mounting bracket and the mounting leg to permit forward and rearward pivoting movement of the hook member and being arranged relative the belt engaging portion of the upper leg so that force applied against the hook member by the belt urges forward pivoting movement of the hook member to maintain the belt engaging portion and belt receiving slot in a downwardly directed belt capturing position; spring means and stop means acting between the mounting bracket and the hook member to normally establish the hook member in the belt capturing position and yielding to permit rearward pivoting of the hook member to release the belt; said resilient support permitting bodily forward pivoting movement of the hook member and mounting bracket under force applied thereto by forward momentum of the restrained occupant whereby the hook member follows the limited forward and downward excursion of the occupant to maintain capture of the belt within the forward facing open end slot.

* * * * *